United States Patent [19]

Becker

[11] Patent Number: 4,724,034

[45] Date of Patent: Feb. 9, 1988

[54] LABELING DEVICE

[75] Inventor: Werner Becker, Hirschhorn/N., Fed. Rep. of Germany

[73] Assignee: Esselte Meto International GmbH, Fed. Rep. of Germany

[21] Appl. No.: 816,855

[22] Filed: Jan. 7, 1986

[30] Foreign Application Priority Data

Jan. 10, 1985 [DE] Fed. Rep. of Germany ..... 3500656

[51] Int. Cl.[4] ..... B41F 1/46; B65C 11/02

[52] U.S. Cl. ..... 156/384; 101/288; 101/305; 101/314; 101/348; 156/DIG. 49

[58] Field of Search ..... 156/384, DIG. 49; 101/288, 295, 305, 309, 314, 320, 348, 354

[56] References Cited

U.S. PATENT DOCUMENTS

| | | | |
|---|---|---|---|
| 3,759,178 | 9/1973 | Franchinot et al. | 101/349 |
| 4,044,677 | 8/1977 | Hamisch, Jr. | 101/348 |
| 4,216,715 | 8/1980 | Sato | 101/288 |
| 4,252,060 | 2/1981 | Strausburg | 156/384 |
| 4,273,046 | 6/1981 | Sato | 101/348 |
| 4,313,377 | 2/1982 | Sato | 101/348 |
| 4,359,939 | 11/1982 | Sato | 101/288 |

FOREIGN PATENT DOCUMENTS 2618502 11/1976 Fed. Rep. of Germany .

2638048 3/1977 Fed. Rep. of Germany .

*Primary Examiner*—Michael Wityshyn

*Attorney, Agent, or Firm*—Gerald J. Ferguson, Jr.; Michael P. Hoffman; Michael J. Foycik, Jr.

[57] ABSTRACT

A labeling device is described with the aid of which self-adhering labels (6) can be imprinted, dispensed and attached to articles. The device includes a printing mechanism (16) having printing types (27) and a means for inking the printing types which includes a pivot member (21) rotatably mounted about a pivot pin (22) and an inking roll (26) which is connected to said member (21) and which prior to each printing operation by pivoting of the pivot member (21) is rolled along the printing types (27) for transferring ink. The inking roll (26) is mounted in an inking roll holder (25) which is adapted to be fitted onto the pivot member (21) in a direction extending radially with respect to the pivot axis (22) of the pivot member (21). At the contact face between the inking roll holder (25) and the pivot member (21) detent means (35, 36) are disposed which secure the inking roll holder (25) in the fitted position on the pivot member (21). The inking roll holder (25) secures the inking roll (26) in a direction extending tangentially to a circle about the pivot axis (22) spaced from the area of which the inking roll holder (25) is fitted onto the pivot member (21).

6 Claims, 14 Drawing Figures

LABELING DEVICE

The invention relates to a labeling device for imprinting, dispensing and attaching self-adhesive labels to articles, comprising a printing mechanism with printing types and a means for inking the printing types which includes a pivot member rotatably mounted about a pivot pin and an inking roll which is connected to said member and which prior to each printing operation by pivoting of the pivot member is rolled along the printing types for transferring ink.

Such a labeling device is known from U.S. Pat. No. 3,817,177. In this known labeling device the pivot member comprises two arms in the free ends of which remote from the pivot axis two slots are formed into which journals provided at the end sides of the inking roll are adapted to be inserted. The slots are so formed that they have a constriction which is so dimensioned that although under application of a certain force the journals can be pressed beyond the constriction into the respective slot said journals are prevented from dropping out. The slots in the pivot member extend in radial direction to the pivot axis so that insertion and removal of the inking roll is also in the radial direction with respect to the pivot axis. In operation of the labeling device a force is exerted on the inking roll during rolling on the printing types which also extends radially to the pivot axis, i.e. exactly in the same direction in which a used inking roll is also removed and a new inking roll inserted. Since the pivoting of the pivot member takes place along an arc round the pivot axis, during each pivoting operation a centrifugal force acts on the inking roll which is directed in the same direction as the radial component of the force exerted when the printing types are rolled along the inking roll. Since the forces acting on the inking roll are also active in the direction in which the inking roll can be removed from the pivot member, the dimensioning of the constrictions in the slots acting as detent means is very critical because two contradictory conditions must be fulfilled. On the one hand, the detent means must not be made so narrow that for removing a used inking roll and inserting a new inking roll excessive forces have to be applied, and on the other hand said means must hold the inking roll so firmly that the journals are securely held even after long use of the device and are not pressed out of the slots in the pivot member in the course of normal operating cycles of the labeling device due to the forces acting on the inking roll.

The invention is based on the problem of further developing a labeling device of the type outlined at the beginning in such a manner that the inking roll of the inking means in spite of a reliable firm fit in the device can be replaced by the operator with little force exertion.

According to the invention this problem is solved in that the inking roll is mounted in an inking roll holder which is adapted to be fitted onto the pivot member in a direction extending radially to the pivot axis of the pivot member, that at the contact surfaces between the inking roll holder and the pivot member detent means are disposed which secure the inking roll holder in the fitted position on the pivot member, and that the inking roll holder holds the inking roll in a direction extending tangentially to a circle about the pivot axis spaced from the area at which the inking roll holder is fitted onto the pivot member.

In the labeling device according to the invention the forces acting during normal operating cycles of the device on the inking roll result in a turning moment being exerted on the inking roll holder which tilts said holder at the pivot member and intensifies the engagement with the detent means. This considerably reduces the danger of the inking roller holder becoming detached from the pivot member during normal operating cycles. The operator can nevertheless withdraw the inking roll holder with a used inking roll from the pivot member in the convenient direction extending radially to the pivot axis. An additional advantage resulting from the use of a special inking roll holder is that the inking roll can be changed without any danger of the operator soiling his fingers with the difficultly removable printing ink.

Further advantangeous developments of the invention are characterized in the subsidiary claims.

One further development resides in that the inking roll holder comprises two arms extending spaced a distance corresponding to the width of the inking roll and a web connecting the arms at one end, that the pivot member for receiving the inking roll holder comprising a tongue extending radially to the pivot axis and having an upper edge connected to the pivot member, a lower free edge opposite said upper edge, and two opposing side edges which are each formed as guide strips, and that in the web of the inking roll holder at the side remote from the arms two grooves formed complementary to the guide strips are disposed which when the inking roll holder is fitted onto the tongue come into engagement with the guide strips. The provision of the guide strips and the guide grooves at the pivot member and inking roll holder respectively makes it far easier for the operator to fit the inking roll holder onto the tongue of the pivot member.

Advantageously, the detent means consists of at least one projection which projects in the direction towards the web of the fitted inking roll holder and beyond which the inking roll holder can be pushed by applying a predetermined force, and that the distance of said at least one projection from the upper edge of the tongue is slightly greater than the height of the web of the inking roll holder in the fitting-on direction. By means of the at least one projection the inking roll holder is securely held on the pivot member. In spite of this projection the inking roll holder can however easily be fitted by the operator onto the tongue of the pivot member because the force which must be exerted to push the inking roll holder beyond the projection is relatively small. To obtain a firm engagement between the inking roll holder and the pivot member under forces acting on the inking roll and inking roll holder, according to the invention at the upper edge of the tongue at least one hook is disposed which engages over the web of the fitted inking roll holder. Under the action of the forces acting in a normal operating cycle on the inking roll holder and the inking roll a particularly effective engagement results between the web of the inking roll holder and the at least one projection and the additionally provided at least one hook so that unintentional detaching of the inking roll holder from the pivot member is not possible.

To increase the effectiveness of the engagement between the at least one hook and the web of the inking roll holder, according to the invention the web of the inking roll holder is mounted with play between the at least one hook and the at least one projection.

The removal of an inking roll from the inking roll holder is made possible according to an advantageous further development of the invention in that the web of the inking roll holder comprises an intended bend point and that the ends of the arms connected to the web are followed towards the web side remote from the arms by grip surfaces for gripping the inking roll holder and spreading the arms apart by exerting oppositely directed forces on said gripping surfaces.

To avoid the inking roll holder being damaged by excessive bending at the intended bend point, in a further development of the invention at the side of the web remote from the arms on either side of the intended bend point a limiting tab is provided for limiting the bending of the web when forces are exerted on the gripping surfaces.

An example of embodiment of the invention will be explained with the aid of the drawings, wherein:

FIG. 1 is a schematic side view of a labeling device according to the invention, the function groups being disposed in the rest position, FIG. 2 is a schematic side view of the labeling device of FIG. 1, the function groups being disposed in an intermediate position, FIG. 3 is a further schematic side view of the labeling device of FIG. 1, the function groups being in the operating position, FIG. 4 is a front view of a pivot member which is part of the inking means used in the labeling device of FIG. 1, FIG. 5 is a section along the line V—V of FIG. 4, FIG. 6 is a section along the line VI—VI of FIG. 4, FIG. 7 is a section along the line VII—VII of FIG. 4, FIG. 8 is a plan view of an inking roll holder with an inking roll shown in dashed line, FIG. 9 is a view of the inking roll holder in the direction of the arrow A of FIG. 8 without inking roll, FIG. 10 is a view of the inking roll holder in the direction of the arrow B of FIG. 8 without inking roll.

Figure 1:
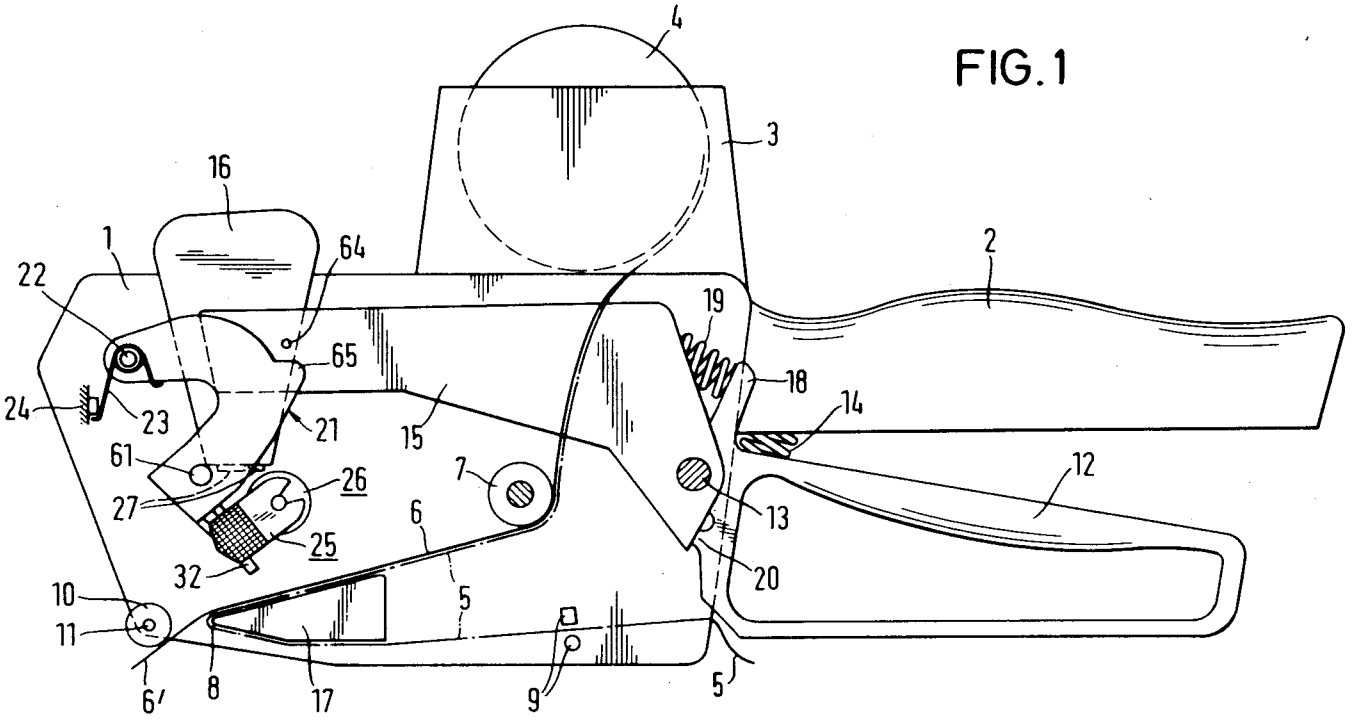

The labeling device in FIG. 1 comprises a housing 1 to which a grip 2 is attached. Disposed at the housing upper side is a well 3 for receiving a supply roll 4 of a carrier tape 5 with self-adhering label 6 adhering thereto. The carrier tape 5 runs in the device from the well 3 firstly downwardly and then after deflection at a roller 7 forwardly to a dispensing edge 8 at which the carrier tape 5 is deflected and past a diagrammatically illustrated feed means 9 to the housing rear end. In front of the dispensing edge 8 an application roller 10 is rotatably mounted about an axis 11, with which a label 6' disposed in the dispensing position and detached at the dispensing edge 8 from the carrier tape 5 can be stuck onto an article by rolling the application roller 10 thereover.

Disposed beneath the handle 2 is an operating lever 12 which is rotatably mounted about an axis 13. Between the handle 2 and the operating lever 12 there is a spring 14 which always tends to press the operating lever 12 into the rest position illustrated in FIG. 1. Also located in the housing 1 is a printing mechanism lever 15 likewise rotatably mounted about the axis 13. Said printing mechanism lever 15 carries a printing mechanism 16 with the aid of which a self-adhering label 6 disposed on a printing table 17 can be imprinted. Between one arm 18 of the operating lever 12 and the printing mechanism lever 15 a spring 19 is disposed which serves to transmit a movement of the operating lever 12 towards the grip 2 to the printing mechanism lever 15. In the rest position illustrated in FIG. 1 the printing mechanism lever 15 is held by a nose 20 at the operating lever 12 in the raised position.

In the front region of the labeling device of FIG. 1 a pivot member 21 is rotatably mounted about an axis 22.

Disposed round the axis or pin 22 is a rotary spring 23 which bears with one end on the pivot member and with the other end on a stop 24 fixed with respect to the housing. The rotary spring 23 exerts on the pivot member 21 a force on the pivot member 21 which tends to turn the latter anticlockwise about the axis 22.

At its lower end the pivot member 21 carries an inking roll holder 25 holding an inking roll 26 with the aid of which printing types 27 disposed at the lower end face of the printing mechanism 16 can be inked. Details of the pivot member 21 are apparent from FIGS. 4, 5, 6 and 7 whilst details of the inking roll holder can be seen in FIGS. 8 to 13.

Figure 4:
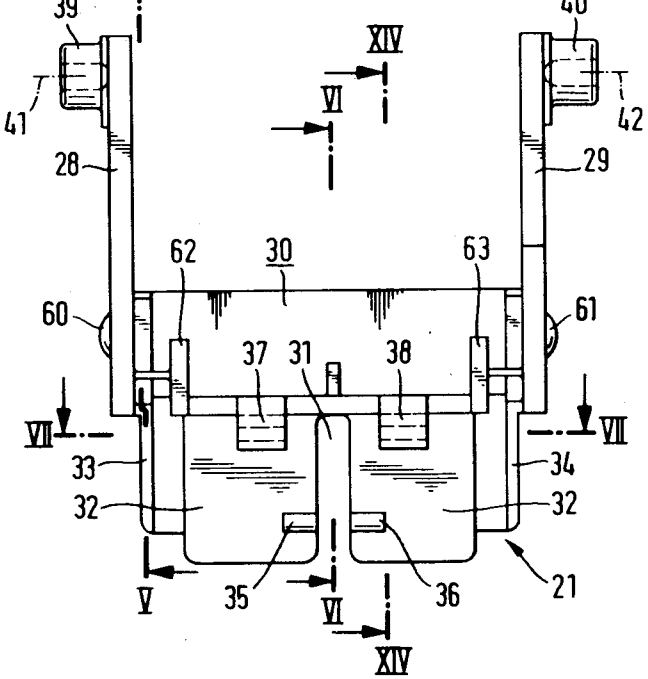
Figure 7:
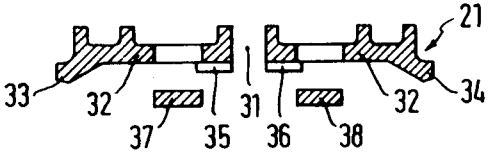
Figure 5:
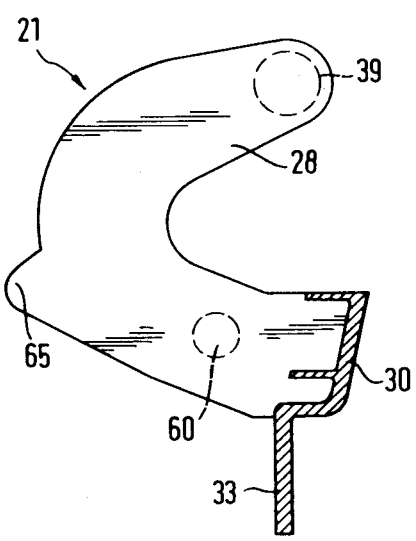

As can be seen in the view of FIG. 4 the pivot member 21 comprises two parallel arms 28, 29 which are connected together at one end by a web 30. At the lower end of the web 30 there is a tongue 32 divided by a slot 31. The side edges of the tongue are constructed as guide strips 33, 34. Furthermore, adjoining the slot 31 in the lower region of the two portions of the tongue 32 there are two projections 35, 36. At the upper end of the tongue 32 two hooks 37, 38 are disposed on either side of the slot 31.

At the upper ends of the arms 28, 29 there are two journals 39, 40 whose axes 41, 42 lie on a common line. These two journals 39, 40 are inserted in the labeling device of FIG. 1 in recesses in the side walls of the housing 1 so that in this manner the axis 22 about which the pivot member 21 can be pivoted in the labeling device is fixed.

The inking roll holder 25 shown in FIGS. 8 to 13 in some cases completely and in other cases in section has two arms 43, 44 which extend parallel to each other and which are connected together by a web 45. In the region of the web 45 at the outside of the arms 43, 44 grip faces 46, 47 are disposed having a knurled surface. On the side of the arms 43, 44 remote from the grip faces 46, 47 grooves 48, 49 are formed whose form is complementary to the form of the guide strips 33, 34 of the tongue 32 at the pivot member 21. The inking roll holder 25 can thus be pushed in the view of FIG. 4 from the bottom radially with respect to the pivot axis 22 over the tongue 32, the guide strips 33, 34 and the grooves 48, 49 coming into engagement.

Figure 8:
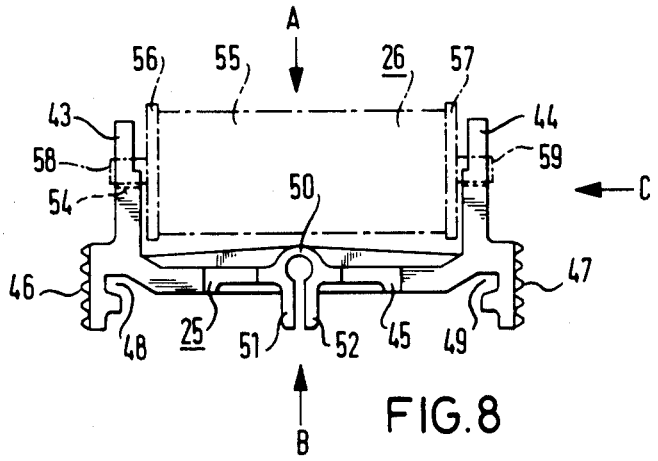
Figure 9:
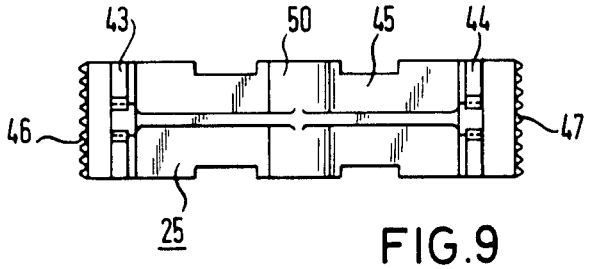
Figure 10:
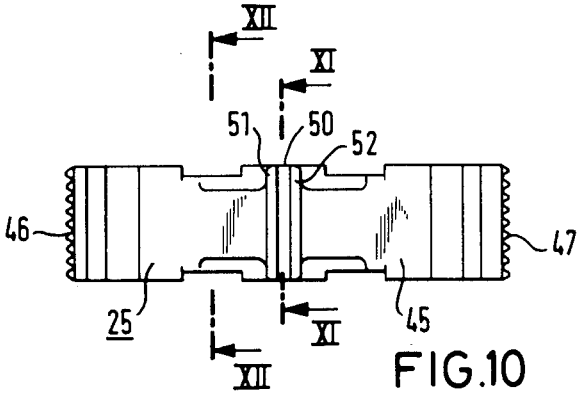

It is apparent from FIG. 8 that the web 45 has two symmemtrical halves which are connected together by an arcuate bridge 50. The bridge 50 extends over the entire height of the web 45. The bridge 50 forms an intended bend point which effects that the ends of the arms 43, 44 disposed at the top in FIG. 8 spread apart when oppositely directed pressure forces are exerted on the grip faces 46, 47. To avoid the bending of the web 45 on exerting such pressure forces being so extensive that the web 45 breaks off at the bridge 50, on the web 45 on the side remote from the bridge 50 two limiting tabs 51, 52 extending over the entire web height are disposed and they run parallel at a predetermined distance apart. Due to the provision of these limiting tabs 51, 52 by exerting pressure on the grip faces 46, 47 the web 45 can be bent only until the limiting lugs or tabs 51, 52 contact each other. Further bending would be possible only by exerting an excessive force.

Figure 11:
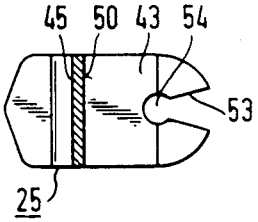
FIG. 11 is a section along the line XI—XI of FIG. 10.
Figure 12:
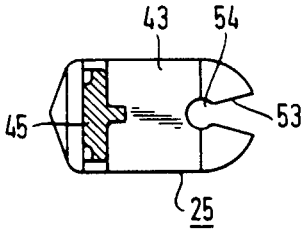
FIG. 12 is a section along the line XII—XII of FIG. 10.
Figure 13:
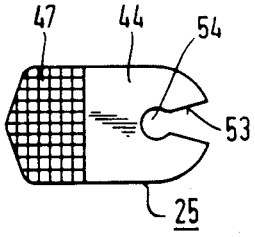
FIG. 13 is a view of the inking roll holder in the direction of the arrow C of FIG. 8

As apparent from FIGS. 11 to 13 in the ends of the arms 43, 44 remote from the grip faces 46, 47 in each case an outwardly conically widening notch 53 is formed which is followed at the inner end by a circular bearing recess 54.

FIG. 8 shows how the inking roll holder 25 carries the inking roll 26. The inking roll 26 consists of an absorbent roll body 55 which is impregnated with printing ink and two discs 56, 57 which adjoin the roll body 55 and from the outer faces of which two journals 58, 59 extend. By insertion of the journals 58, 59 into the notches 53 of the arms 43, 44 and by pressing into the bearing recesses 54 the inking roll 26 can be mounted in the inking roll holder 25. The bearing recesses 54 are so dimensioned that they permit unrestricted rotating of the inking roll 26 about the journals 5 8, 59. Due to the constriction at the transition between the notches 53 and the bearing recesses 54 the journals 58 and 59 are reliably mounted in the bearing recesses 54 so that the inking roll 26 cannot drop out of the inking roll holder 25. For removing an inking roll 26 from the inking roll holder 25 the arms 43, 44 must be pushed apart by exerting pressure on the grip faces 46, 47 to such an extent that the journals 58, 59 come out of engagement with the bearing recesses 54. The inking roll 26 then drops out of the inking roll holder 25. This procedure must be carried out when a used inking roll is to be replaced by a new inking roll.

Figure 14:
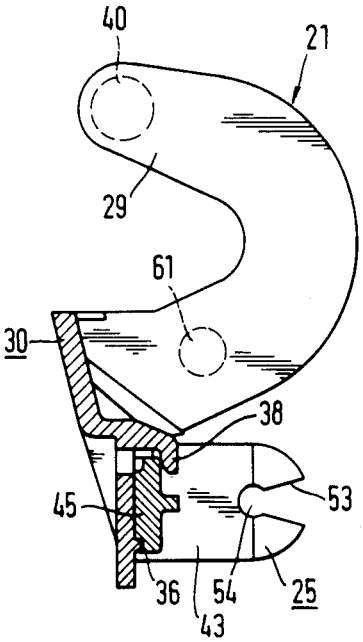
FIG. 14 is a section along the line XIV—XIV of FIG. 4, the inking roll holder of FIG. 10 sectioned along the line XII—XII being inserted into the pivot member.

The inking roll holder 25 is secured on the pivot member 21 by cooperation between the projections 35, 36 and the hooks 37, 38 with the web 45 of the inking roll holder 25. FIG. 14 shows how the inking roll holder 25 is inserted into the pivot member 21 and held by the projections and hooks.

Figure 2:
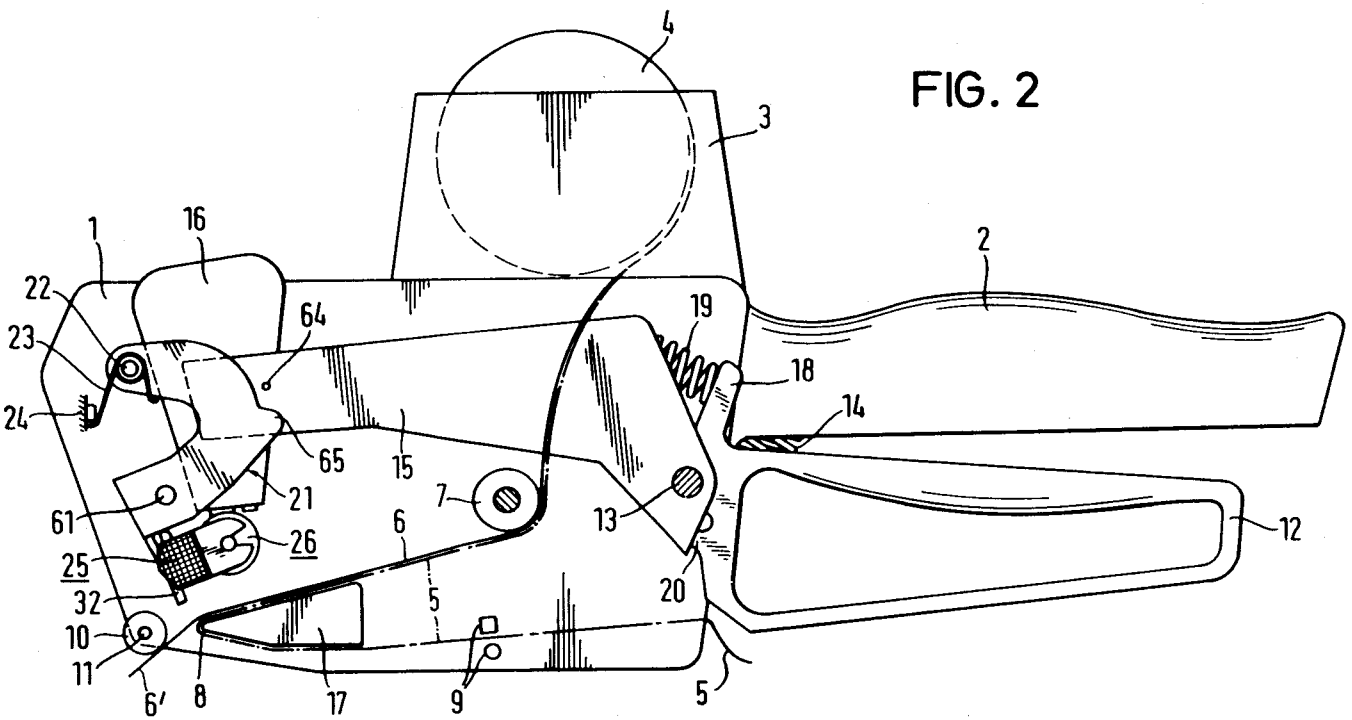
Figure 3:
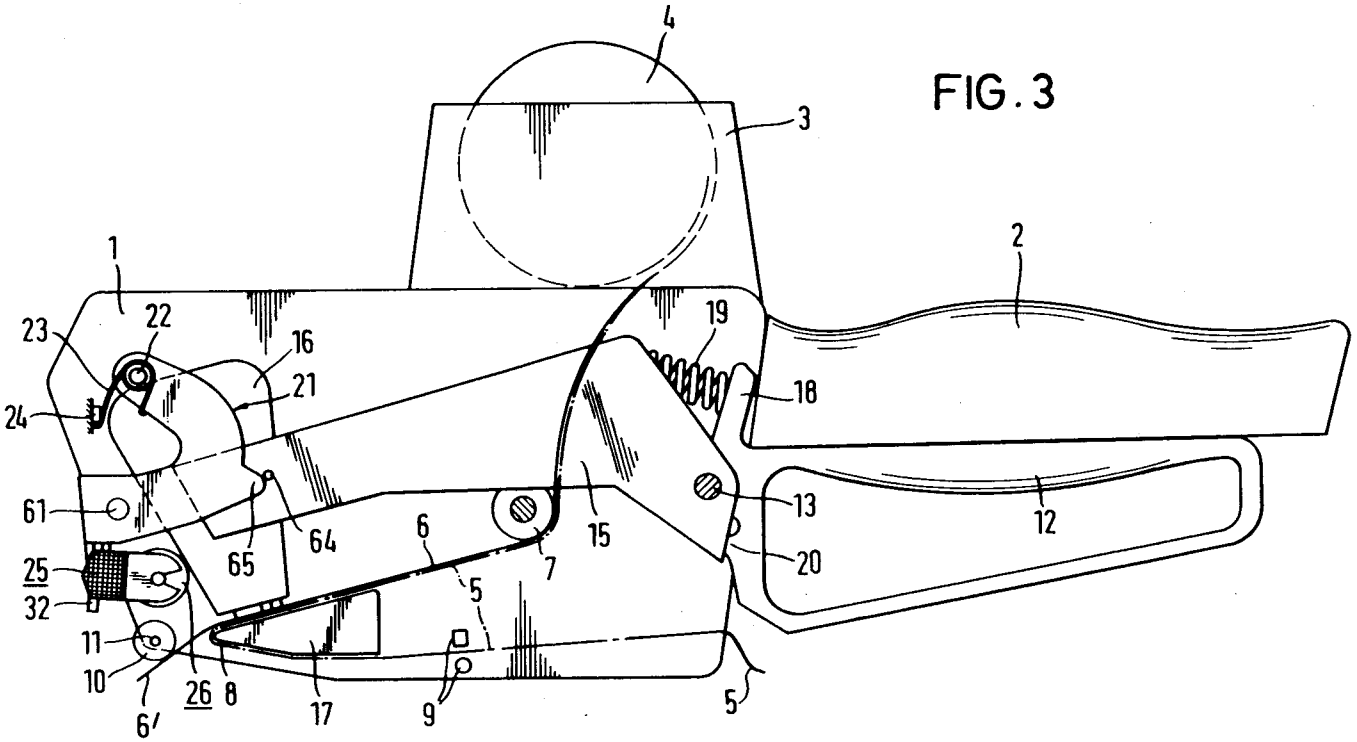
Figure 6:
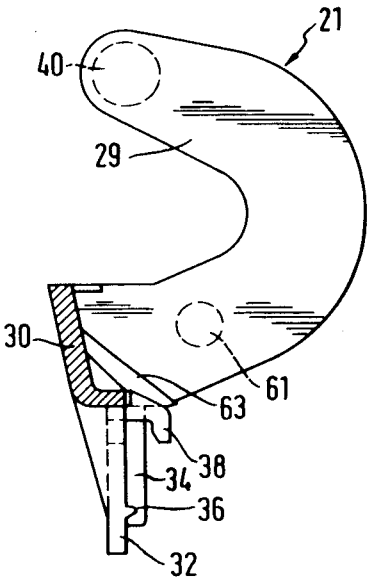

With reference to FIGS. 1 to 3 an operating cycle of the labeling device will now be described. For initiating an operating cycle the operating lever 12 is pulled towards the grip 2 and as a result the pressure mechanism lever 15 due to the action of the arm 18 and spring 19 is pivoted anticlockwise about the axis 13 so that the printing mechanism 16 moves in the direction towards the printing table 17. Immediately after the start of the lowering movement the printing types 27 disposed at the end side of the printing mechanism 16 come into contact with the roll body 55 of the inking roll 26. On further lowering the roll body rolls over the printing types 27 with pivoting of the pivot member 21 into the position shown in FIG. 2. As soon as the printing types 27 have been inked, on further lowering of the printing head 16 the discs 56, 57 of the inking roll 26 come into contact with the printing mechanism housing. Since the peripheral faces of the discs 56, 57 in accordance with FIG. 8 project slightly beyond the peripheral face of the roll body 55, the latter is held spaced from the housing of the printing head 16 so that transfer of ink onto the printing mechanism housing is avoided. It can be seen from FIG. 3 how the discs 56, 57 bear on the housing of the printing mechanism 16 and hold the roll body 55 spaced from the housing when the printing mechanism 16 is lowered completely onto the printing table 17. The pivot member 21 is pivoted to such an extent that the lower end of the tongue 32 projects out of an opening in the end side of the housing 1 of the labeling device as apparent from FIG. 3.

Via a lever connection not illustrated the feed means 9 has been simultaneously moved from the position illustrated in FIG. 1 in the direction towards the printing table 17 along the carrier tape 5. When the operating lever 12 is released the spring 14 returns said lever into the starting position shown in FIG. 1, the nose 20 again pivoting the printing mechanism lever 15 clockwise about the axis 13 into its starting position as illustrated. Simultaneously, the feed means 9 is also returned to its starting position illustrated in FIG. 1; during this movement it is however in firm engagement with the carrier tape 5 so that the latter is pulled round the dispensing edge 8 a distance corresponding to the length of a self-adhering label. As this is done a self-adhering label detaches from the support tape at the dispensing edge 8 and moves into the position of the self-adhering label 6' beneath the application roller 10. The self-adhering label 6' can now be stuck to an article by rolling the application roller 10 thereover.

When a used inking roll 26 is to be replaced by a new one, the operator brings the pivot member 21 by pulling the operating lever into the position illustrated in FIG. 3 in which the tongue 32 projects at the end side of the housing 1 of the labeling device. By gripping the tongue 32 the operator can pivot the pivot member 21 still further out of the opening formed in the housing end side so that finally the inking roll holder 25 and the inking roll 26 are located outside the housing 1. To ensure that the pivot member 21 remains in this outwardly pivoted position even when the tongue 32 is released, at the side faces of the pivot member 21 the protrusions 60, 61 apparent in FIG. 4 are provided and are so dimensioned that the distance from the apex of the protrusion 60 to the apex of the protrusion 61 is slightly greater than the internal width of the opening in the end face of the housing 1. Although by exerting a certain force the pivot member 21 can be pivoted past the protrusion 60, 61 out of the opening at the end side of the housing 1, the force of the turning spring 23 is not sufficient to pivot it back into the housing again. The pivot member 21 thus remains in a position in which the inking roll holder 25 can easily be removed from the pivot member 21 for the purpose of replacing the inking roll 26.

As already explained in conjunction with FIG. 14 the inking roll holder is secured by cooperation of the projections 35, 36 and the hooks 37, 38 with the web 45 on the pivot member 21. The inking roll holder 25 is however mounted with relatively large play between the projections 35, 36 and the hooks 37, 38 so that it can be readily removed downwardly from the tongue 32 by the operator. For this purpose the operator need only turn the inking roll 25 slightly anticlockwise in the view of FIG. 14 so that the back of the web 45 can slide over the projections 35, 36 and the inking roll holder 25 thus be removed from the pivot member 21. As mentioned above, by exerting pressure on the grip faces 46, 47 and the resulting spreading of the arms 43, 44 the inking roll 26 can easily be removed from the inking roll holder 25 and replaced by a new inking roll.

In spite of the relatively loose fit of the inking roll holder 25 at the tongue 32 of the pivot member 21 because of the specific configuration of the cooperating parts there is no danger of the inking roll holder 25 becoming detached from the pivot member 21 during normal operation of the labeling device. When the roll body 55 is rolled over the printing types 27 forces extending in the radial direction with respect to the pivot axis 25 also act on the inking roll 26 and the inking roll holder 25. Furthermore, in the pivot movement of the pivot arm 21 about the axis 22 occurring during an operating cycle centrifugal forces act on the inking roll 26 and the inking roll holder 25 and tend to shift the inking roll holder 25 in the direction in which it must also be moved for removal from the pivot member 21. The connection between the inking roll holder 25 and the pivot member 21 must therefore be at least so firm that the forces occurring do not lead to detaching of the inking roll holder from the pivot member 21. This is achieved in particular in that the forces exerted by the printing types 27 and the centrifugal force acting on the inking roller 26 exert on the inking roll holder 25 a turning moment which tends to turn the inking roller 25 in the view of FIG. 14 in the clockwise direction. Due to this turning the projections 35, 36 come into firmer engagement with the web 45 so that the inking roll holder 25 in spite of its relatively loose fit is securely held on the pivot member 21. It is precisely because of this relatively loose fit that this tilting of the inking roll carrier occurs which leads to the secure holding. Turning of the inking roll holder 25 anticlockwise, as must be performed by the operator for disengaging the connection, does not occur in normal operation of the labeling device.

Should the operator when changing an inking roll unintentionally knock against the pivot member 21 projecting at the end side of the housing 1 so that said pivot member after overcoming the restriction provided by the protrusions 60, 61 pivots back again into the housing, it is difficult to pivot said member out again to such an extent that the inking roll holder 25 with the new inking roll 26 can be inserted. It might also occur, unless special measures are adopted, that the hooks 37, 38 come into contact with the printing types 27 at the printing mechanism 16 so that on subsequent operation of the device they catch on said printing types. As remedy, two measures are taken which result firstly in preventing jamming and catching of the pivot member on the printing mechanism 16 and secondly enable the pivot member 21, solely by actuating the operating lever 12, to be pivoted out of the device again to such an extent that the inking roll holder 25 can be inserted. The pivot member 21 is equipped according to FIG. 4 with two inclined faces 62, 63, of which the inclined face 63 is clearly apparent in FIG. 6. The end side of the printing mechanism 16 comes into contact with these inclined faces when said mechanism is lowered by actuating the operating lever 12 and the inking roll holder 25 is removed from the pivot member 21. However, the pivoting of the pivot member 21 effected by cooperation of the inclined faces 62, 63 with the printing mechanism 16 does not suffice to pivot the pivot member 21 to such an extent with respect to the end side of the housing 1 that the operator can easily grip the tongue 32. For further pivoting of the pivot member 21 on the printing mechanism lever 15 a stop 64 is disposed which when the printing mechanism lever 15 is lowered comes into enagement with a nose 65 on the pivot member 21 so that on further lowering of the printing mechanism lever 15 the pivot member 21 is pivoted out of the housing 1 until it assumes the position illustrated in FIG. 3 which it would also assume if the inking roll holder 25 and inking roll 26 were present. The operator can thus grip the pivot member 21 at the tongue 32 and return it to the position in which the inking roll holder 25 can be easily pushed onto the tongue 32.

The labeling device described thus includes an inking means for the printing types of the printing mechanism which permits simple and convenient replacing of the used inking roll and nevertheless holds the inking roll holder firmly and securely on the pivot member 21 so that unintentional detaching of the inking roll holder 25 from the pivot member 21 is impossible.

I claim:

1. Labeling device for imprinting, dispensing and attaching self-adhesive labels to articles, comprising:

a printing mechanism with printing types;

means for inking the printing types which includes a pivot member rotatably mounted about a pivot pin and an inking roll having a width and mounted in an inking roll holder, said inking roll being connected to said member and being rolled along the printing types for transferring ink prior to each printing operation by pivoting of the pivot member, said inking roll holder holding the inking roll in a direction extending tangentially to a circle about the axis of said pivot pin, which pivot pin axis is spaced from an area at which the inking roll holder is fitted onto the pivot member, said inking roll holder further comprising two arms connected by a web at one end and extending spaced a distance corresponding to the width of the inking roll, said pivot member comprising a tongue extending radially to the pivot pin axis and having an upper edge connected to the pivot member, a lower free edge opposite said upper edge, and two opposing side edges which are each formed as guide strips;

means disposed at a contact surface between the inking roll holder and the pivot member for securing the inking roll holder in a fitted position on the pivot member, said means for securing comprising at least one projection on said tongue which projects in a direction towards the web of the fitted inking roll holder and beyond which the inking roll holder can be pushed by applying a predetermined force, a distance of the at least one projection from the upper edge of the tongue being slightly greater than a height of the web of the inking roll holder in the fitting-on direction; and two grooves disposed in the web of the inking roll holder, at a side remote from the arms, said grooves formed complementary to the guide strips which grooves, when the inking roll holder is fitted onto the tongue, come into engagement with the guide strips.

2. Labeling device according to claim 1 wherein said means for securing further comprises dentent means.

3. Labeling device according to claim 1, wherein at least one hook is disposed at the upper edge of the tongue which engages over the web of the fitted inking roll holder.

4. Labeling device according to claim 3, wherein the web of the inking roll holder is mounted with play between the at least one hook and the at least one projection.

5. Labeling device according to any one of claims 1, 3 and 4 wherein the web of the linking roll holder comprises an intended bend point and the ends of the arms connected to the web are followed towards the web side remote from the arms by grip surfaces for gripping the inking roll holder and spreading the arms apart by exerting oppositely directed forces on said gripping surfaces.

6. Labeling device according to claim 5, wherein at the side of the web remote from the arms on either side of the intended bend point limiting tabs are provided for limiting the bending of the web when forces are exerted on the gripping surfaces.

* * * * *